US006997205B2

(12) United States Patent
Kocek

(10) Patent No.: US 6,997,205 B2
(45) Date of Patent: Feb. 14, 2006

(54) INLET PROTECTION APPARATUS AND METHOD

(76) Inventor: Glenn L. Kocek, 343 N. Dover, LaGrange Park, IL (US) 60526

( * ) Notice: Subject to any disclaimer, the term of this patent is extended or adjusted under 35 U.S.C. 154(b) by 0 days.

(21) Appl. No.: 10/306,955

(22) Filed: Nov. 29, 2002

(65) Prior Publication Data

US 2003/0222788 A1 Dec. 4, 2003

Related U.S. Application Data

(60) Provisional application No. 60/334,457, filed on Nov. 29, 2001.

(51) Int. Cl.
*E03B 11/00* (2006.01)

(52) U.S. Cl. ..... 137/15.01; 377/574; 377/589; 251/127; 138/42

(58) Field of Classification Search ..... 137/377, 137/382, 587, 589, 15.01, 574; 251/127; 138/42

See application file for complete search history.

(56) References Cited

U.S. PATENT DOCUMENTS 1,856,492 A * 5/1932 Marshall ..... 137/512.3
5,117,862 A * 6/1992 Molligan ..... 137/527.8
5,810,029 A * 9/1998 Speros et al. ..... 137/377

* cited by examiner

*Primary Examiner*—A. Michael Chambers
(74) *Attorney, Agent, or Firm*—Fitch, Even, Tabin & Flannery

(57) ABSTRACT

An apparatus and method for substantially preventing access to an inlet of a vent. The apparatus may comprise a housing attachable to the inlet of the vent and having one or more traps position therein to block insertion of a fluid insertion device through the housing and to the inlet of the vent. The traps may be formed by intersections of interior panels within the housing. The traps may be configured to allow fluid flow to exit the vent inlet and pass through the housing before venting.

17 Claims, 6 Drawing Sheets

INLET PROTECTION APPARATUS AND METHOD

This application claims the benefit of U.S. Ser. No. 60/334,457 filled Nov. 29, 2001.

FIELD

The invention relates generally to an inlet protection apparatus, and particularly to a protection apparatus for a storage tank inlet.

BACKGROUND

Tanks are often used for storing and processing liquids, such as for municipal water treatment and delivery systems. Water storage tanks may be above ground, or may be buried underground. For underground water storage tanks, vents are often provided to the atmosphere to allow air flow into and out of the tank. For example, when the volume of water in tank is increased, displaced air may be vented to the atmosphere to prevent the pressure in the tank from increasing beyond acceptable limits.

The vents for water storage tanks are typically U-shaped pipes. The vent pipes may extend upwardly from the tank to above ground level, and then curve back towards the ground level, but still spaced a distance therefrom. The inlet of the vent pipe, and thus the inlet of the water storage tank, faces downwardly toward the ground.

A screen is often provided over the vent pipe inlet to prevent small animals from entering the pipe. However, the screen may easily removed, permitting access to the pipe inlet, such as by cutting, bending, or simply forcing it off. A hose or other insertion device could be placed into the pipe inlet, allowing the introduction of foreign matter, such as contaminants, into the water storage tank which can contaminate any water therein. Accordingly, there remains a need for protecting water in a water storage tank from contamination caused by introduction of contaminants into a vent pipe inlet through a hose or other insertion device.

SUMMARY

An inlet protection apparatus and method is provided to prevent insertion of contaminants through the inlet. The apparatus may be placed on a water storage tank vent pipe inlet to prevent the insertion of a hose or other insertion device into the inlet.

In an aspect, the apparatus comprises a housing adapted for attachment to the inlet of the vent pipe. An entrance may be provided in the housing to allow for fluid flow into the housing from the vent pipe. The housing may also include an exit to allow fluid to vent from within the housing. One or more baffles may be provided within the housing and between the fluid entrance and exit. The baffles may be configured to prevent the placement of an insertion device at least partially through the housing, and may be configured to prevent the insertion device from introducing contaminants into the inlet of the vent pipe and thus into water in the water storage tank.

The housing, baffles, entrance, and exit may be configured to allow for adequate air flow between the vent pipe inlet and the atmosphere to provide for substantially customary venting operation of the water storage tank.

The baffles may define a plurality of traps or pockets effective to hinder threading of a hose or other insertion device through the housing and into or proximate to the vent pipe inlet. The baffles may comprises a plurality of members sloping toward the exit of the housing, thereby directing any aqueous fluid or contamination within the housing toward and out of the exit. The baffles may also be attached to walls of the housing to prevent fluid from reaching the vent pipe entrance by pressure forcing.

The housing may be adapted to readily retrofit existing vent pipes, or may be integrally formed within vent pipes or water storage tanks. Existing U-shaped vent pipes may be retrofitted with the apparatus by attachment to the inlet of the vent pipe, such as with bolts or by welding. The housing may be sized to extend between the vent pipe inlet and ground level, and may be spaced a distance above ground level. An existing vent pipe may be elevated with an extension pipe. The apparatus may be formed of a stainless steel or other anti-corrosive material. The baffles may be welded to the housing walls, or attached using other joining techniques. The housing may be adapted for attachment of a screen to partially block the exit thereof.

In another aspect, an access restriction apparatus for substantially preventing insertion of a fluid introduction device into an inlet of a vent is provided. The apparatus comprises a housing having an entrance opening and an exit opening, the entrance opening being positioned adjacent the inlet of the vent for allowing fluid flow from the inlet of the vent, past the entrance opening, through the housing, and past the exit opening. The housing has one or more traps positioned between the entrance opening and the exit opening to substantially prevent insertion of a fluid introduction device into the inlet of the vent while allowing fluid flow from the inlet of the vent, past the entrance opening, through the housing, and past the exit opening.

In another aspect, the traps of the apparatus each may comprise the intersection of a pair walls. One of the walls may comprise a portion of the housing and the other of the walls comprises an inner panel positioned within the housing. Instead or in addition to this intersection, the walls may comprise a pair of inner panels positioned within the housing. At least one of the walls, and preferably most of the wall, forming the intersection may be inclined upwardly toward the entrance opening of the housing. A blocking panel may also be provided within the housing spaced a predetermined distance from the exit opening and generally parallel to the exit opening, the blocking panel being configured to permit passage of fluid therepast. The blocking panel may be spaced from a wall of the housing to permit fluid to flow between the blocking panel and the wall of the housing. The blocking panel may include one or more openings to permit fluid to flow therepast. When a plurality of traps are provided, the traps may be positioned on alternating sides of the housing. The walls are secured to sidewalls of the housing.

A method of substantially restricting access to an inlet of a vent by an insertion device is provided. The method includes providing a housing having an entrance opening and an exit opening. The method further includes configuring the interior of the housing to have one or more traps substantially restricting passage of the insertion device from the exit opening to the entrance opening and allowing passage of fluid from the entrance opening to the exit opening. The method also includes attaching the entrance opening of the housing to the inlet of the vent to permit fluid flow from the inlet of the vent to the entrance opening of the housing.

An aspect of the method may include the step of forming the one or more traps by intersecting two walls positioned within the housing. The step of inclining at least one of the walls forming the traps toward the entrance opening of the housing may be included in the method. The method may include the step of securing at least one of the walls to the interior of at least one wall forming the housing. The method may include the step of raising the elevation of the inlet of the vent pipe by positioning an extension between the inlet and an outlet of the vent, the extension permitting fluid flow between the outlet and the inlet of the vent.

DETAILED DESCRIPTION

An apparatus and method are provided for substantially restricting access to an inlet of a vent or pipe, as illustrated in FIGS. 1–9.

Figure 2:
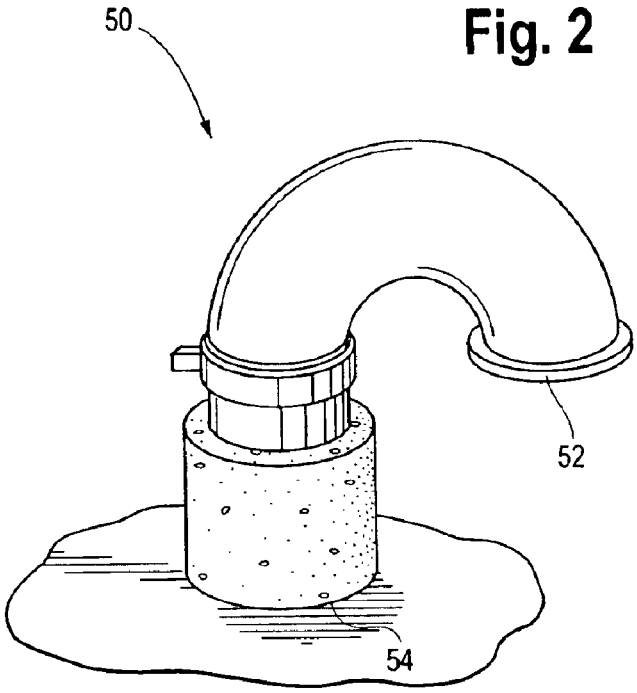
FIG. 2 is a perspective view of a typical tank vent pipe.
Figure 3:
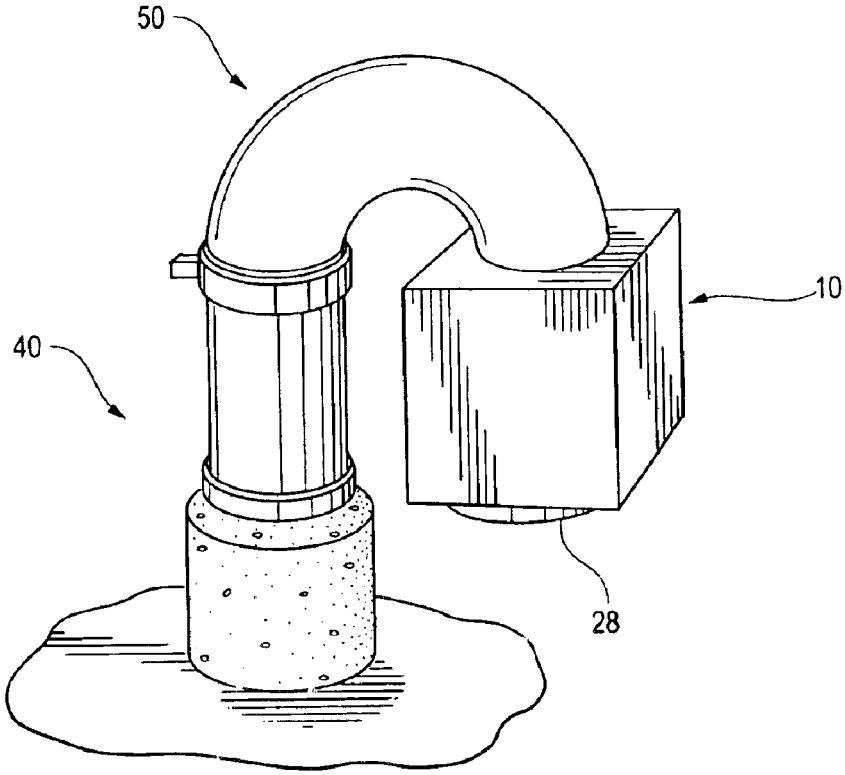
FIG. 3 is a perspective view of a tank vent pipe having an apparatus for restricting access to the inlet attached thereto.

The vent comprises a generally U-shaped vent pipe 50 having an inlet 52 and an outlet 54, as illustrated in FIG. 2. The apparatus 10 for substantially restricting access to the inlet 52 of the vent 50 is attached proximate the inlet 52, as illustrated in FIG. 3. The apparatus comprises a housing 20 defining an interior with a plurality of traps 30 positioned therein for substantially preventing insertion of a fluid introduction device into the inlet 52 of the vent 50.

Turning to more details of the apparatus 10 for substantially restricting access to the inlet 52 of the vent 50, the apparatus 10 generally comprises a housing 20. The housing 20 is preferably rectangular in shape and is formed of a plurality of sidewalls 22, although other configurations, such as cylindrical, of the housing are equally suitable. The sidewalls 22 of the housing 20 define an interior thereof. One end of the housing 20 has an entrance opening 24 and the opposite end of the housing has an exit opening 26. The entrance and exit openings 24 and 26 of the housing 20 are configured to permit the passage of fluid into the housing 20 and from the housing 20.

A plurality of traps 30 are provided within the housing 20 for substantially blocking passage of a fluid insertion device, such as a hose, through the housing 20 and to the inlet 52 of the vent 50. The traps 30 are configured to impede the threading of the insertion device through the housing 20 by providing a plurality of dead ends where further passage is prevented, as illustrated in FIG. 9.

Figure 9:
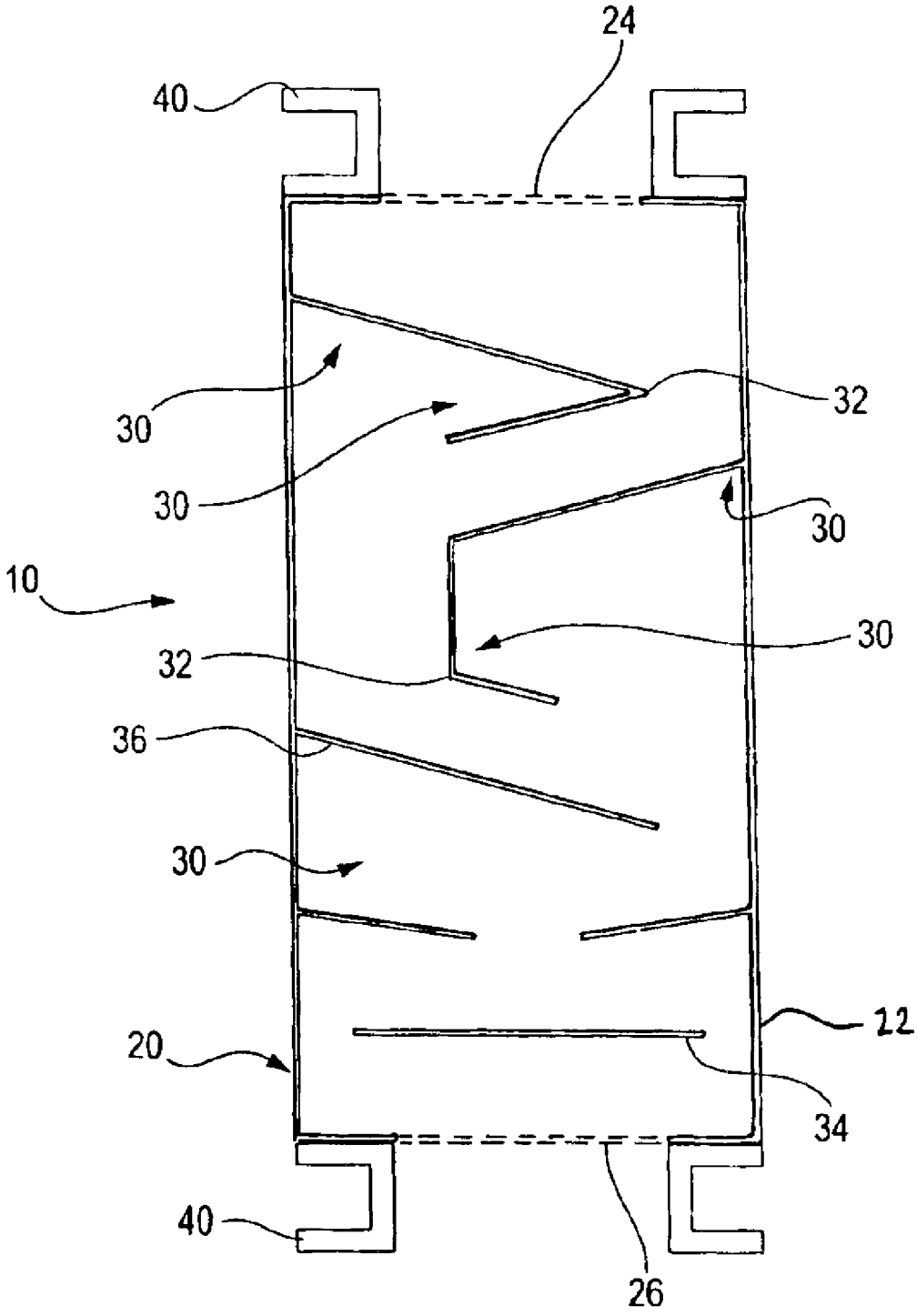
FIG. 9 is a section view of an apparatus for substantially restricting access to an inlet of a vent.

The dead ends of the traps 30 are formed by intersections 32 between interior panels 22 and 36 within the housing, as illustrated in FIG. 9. Some of the intersections 32 comprise panels 36 attached to the interior of the housing 20. Others of the intersections comprise a panel 36 attached to an interior of the sidewall 22 of the housing 20. The panels 36 are inclined upward toward the entrance opening to direct any insertion device into the traps 30. The spacing between the panels 36 is selected to substantially ensure the blocking or any insertion device being attempted to pass through the housing 20 while permitting venting of fluid from the inlet 52 to the vent 50.

A blocking panel 34 is provided within the interior of the housing 20 and spaced a predetermined distance from the exit opening 26 of the housing 20. The blocking panel 34 is substantially parallel to the exit opening 26 and provides an initial hindrance to the insertion of a fluid insertion device. The blocking panel 34 is spaced a distance from a pair of opposing sidewalls 22 of the housing 20 to permit fluid passage therepast while restricting passage of a fluid insertion device.

Figure 8:
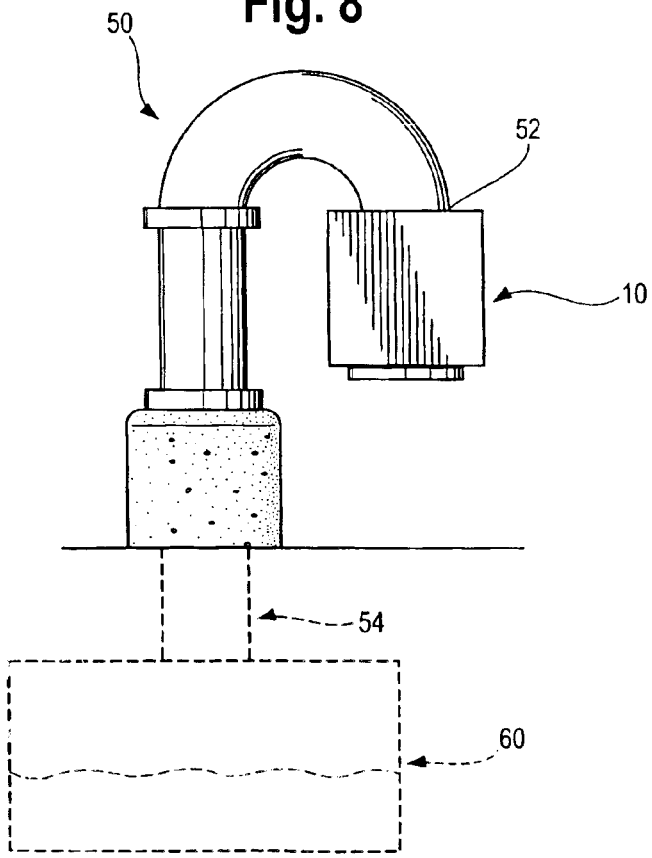
FIG. 8 is an illustration of in apparatus for substantially restricting access to an inlet of a vent attached to a vent pipe for a water storage tank.

The vent 50 may be for a water storage tank 60, as depicted in FIG. 8. The water storage tank 60 may be positioned at least partially beneath the ground. Changes in the conditions within the water storage tank 60 may result in fluid, such as air, being vented from the tank 60 to the atmosphere via the vent 50 by passing through the outlet 54 of the vent, through the vent 50, and exiting through the inlet 52 of the vent 50. When the apparatus 10 is attached to the inlet 52 of the vent 50, the fluid passes therethrough prior to exiting to the atmosphere. When the inlet 52 to the vent 50 is closely proximate the ground, an extension 40 may be provided between the vent inlet 52 and outlet 54 to raise the elevation of the vent inlet 52 above the ground to accommodate attachment of the housing 20 thereto, as illustrated in FIG. 3.

Attachment brackets 38 are provided on the ends of the housing 20 to permit the housing 20 to be attached to the inlet 52 of the vent pipe and to permit attachment of a screen 28. The screen 28 is provided over the exit opening 26 of the housing 20 to restrict passage of debris, animals, and insects into the housing 20. Preferably, the entrance opening 24 of the housing 20 is attached to the inlet 52 of the vent 50 to permit passage of fluid therethrough.

The housing 20 and panels 36 are preferably formed of a corrosion resistant material having a strength sufficient to prevent unauthorized breaking or tearing thereof. The material is preferably a corrosion resistant steel sheeting capable of inexpensive folding and shaping. The panels 36 are preferably welded into the interior of the housing 20 by attachment to the sidewalls 22, although other attachment operations are also suitable.

Figure 1:
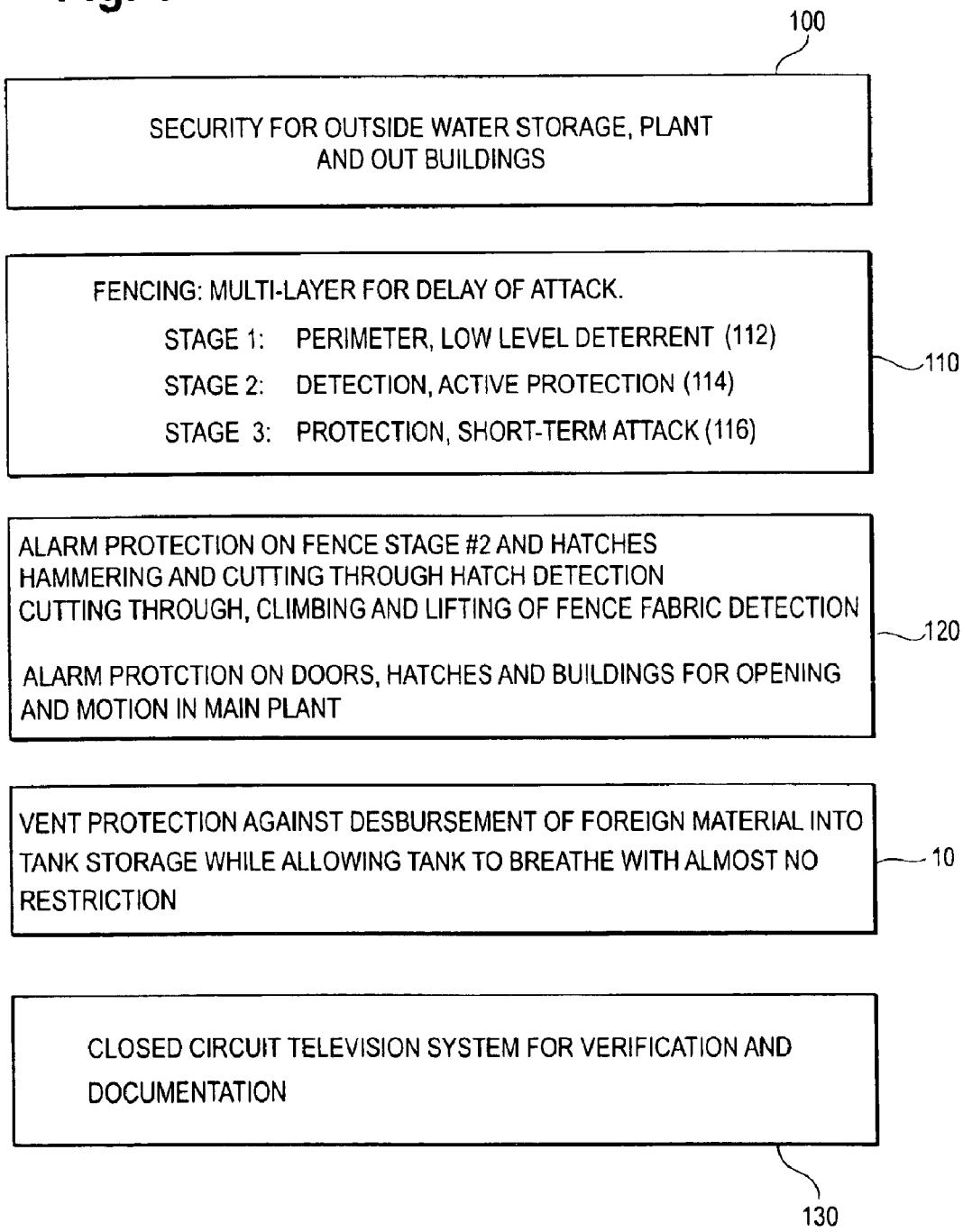
FIG. 1 is a schematic for a security system and method for protecting a facility.

The apparatus 10 for restricting access to the inlet 52 of the tank vent pipe 50 may be part of a security set up for the water facility 100. For example, the water facility 100 may include outside water storage in the form of an above ground or underground water storage tank 60, water plant buildings, and out buildings. The security set up for preventing tampering with the facility 100 may include fencing 110, alarm protection 120, vent protection apparatus 10, and visual monitoring 130, as depicted in FIG. 1.

Figure 4:
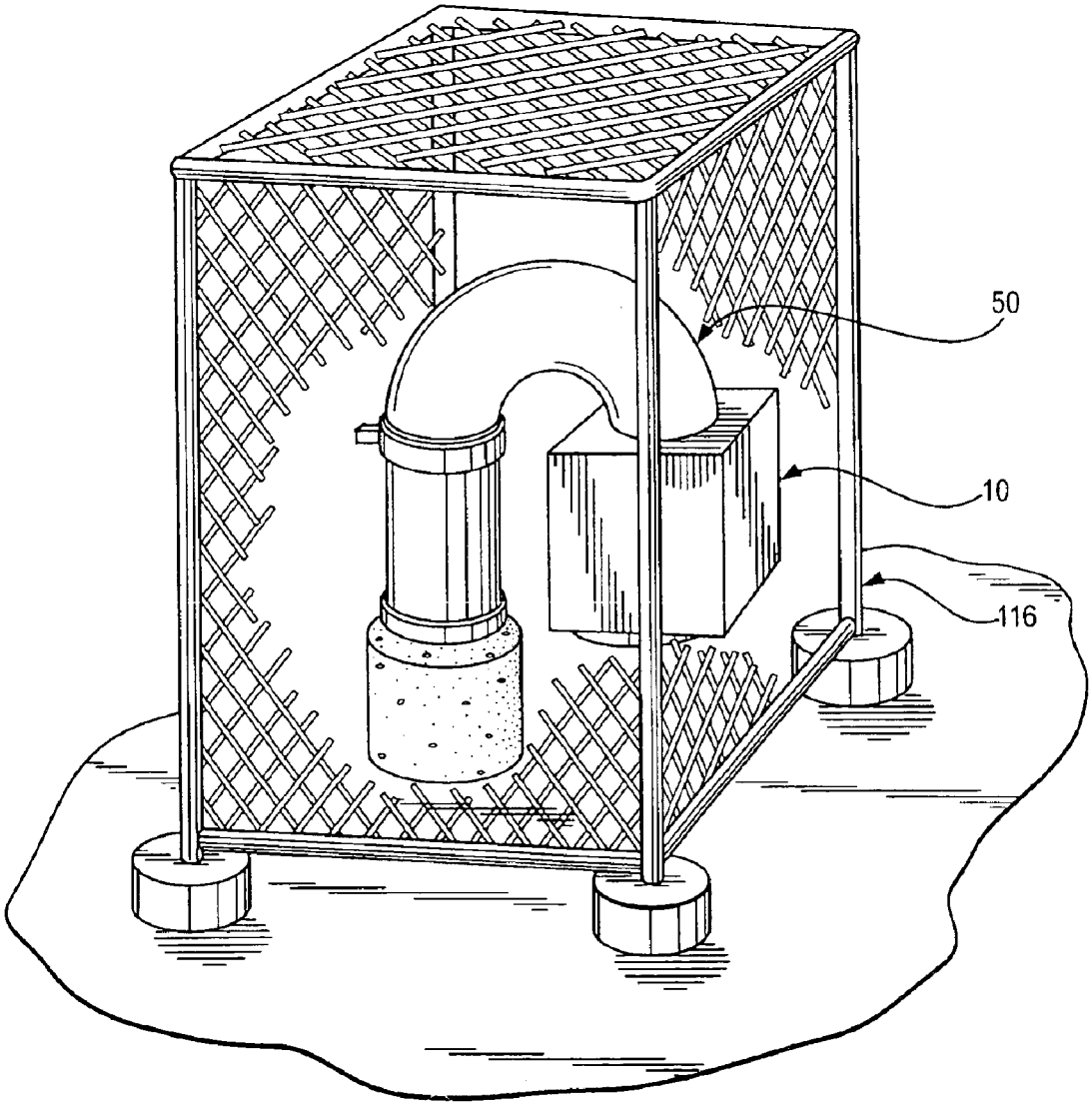
FIG. 4 is a perspective view of a security arrangement for the tank vent pipe with attached apparatus of FIG. 3.
Figure 5:
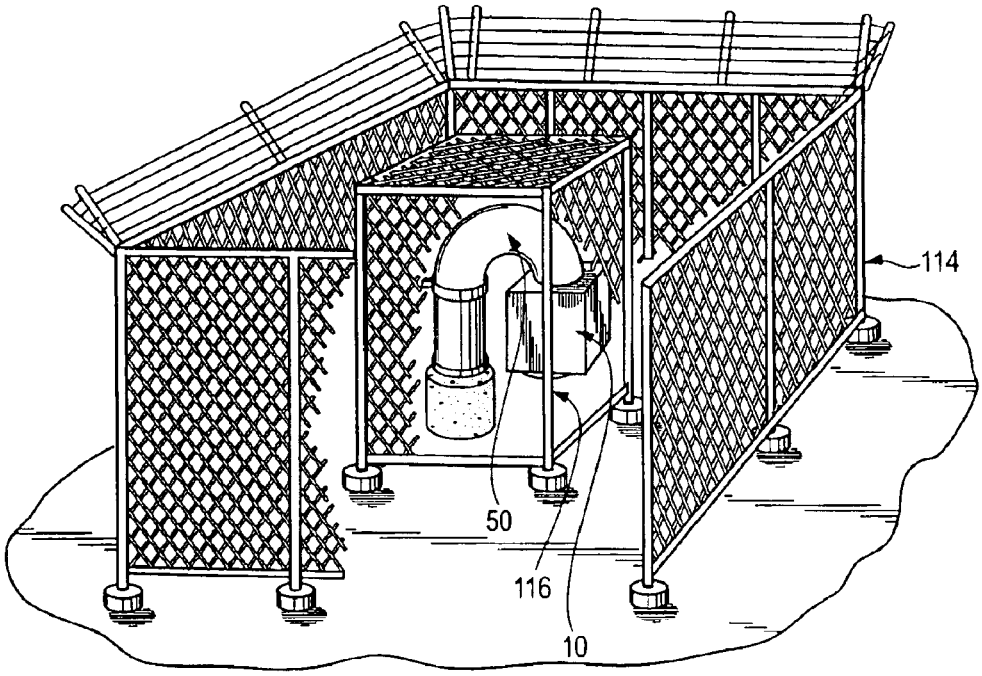
FIG. 5 is a perspective view of security arrangements for the tank vent pipe with attached apparatus of FIG. 3.
Figure 6:
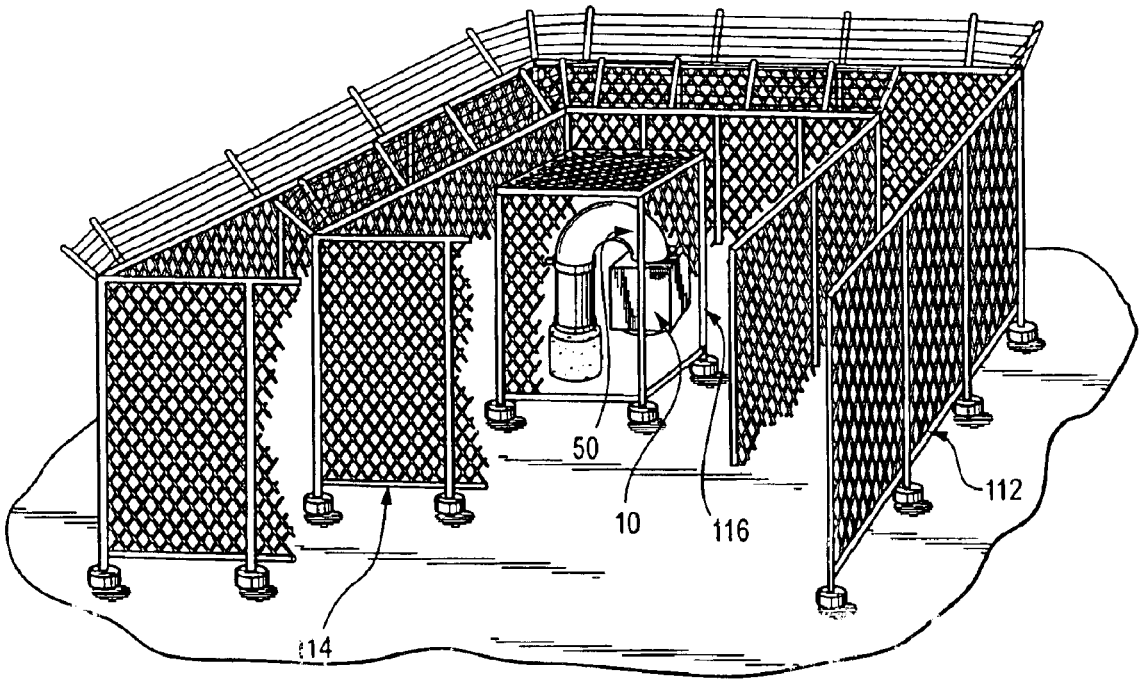
FIG. 6 is a perspective view of security arrangements for the tank vent pipe with attached apparatus of FIG. 3.
Figure 7:
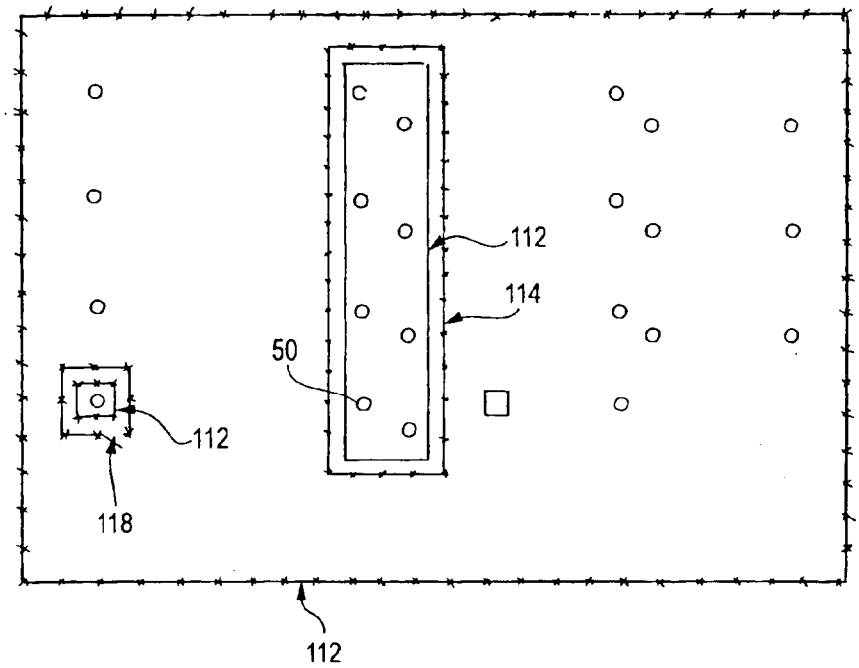
FIG. 7 is a plan view of security arrangements for the tank vent pipe with attached apparatus of FIG. 3.

The fencing 110 may comprise multiple layers for the purpose of delaying unauthorized access to the facility 100. The perimeter of the facility 100 may be surrounded by stage one fencing 112 to provide a low level of initial deterrence. The stage one fencing 112, as illustrated in FIG. 6, may comprise chain link fencing having one or more strands of barbed wire, strands of razor wire, or coils of razor wire along the upper edge thereof. Inside the stage one 112 fencing may be stage two fencing 114. Stage two fencing 114 may be configured for active detection, such as by alarms or other monitoring devices 120. For example, alarms 120 may be configured to detect cutting, climbing, or lifting of the fencing 114. The stage two fencing 114 may be similar in construction to the stage one fencing 112, comprising chain link fencing with barbed wire or razor wire at its upper edge, as illustrated in FIG. 5. Stage three fencing 116 may be provided within the stage two fencing 114, and is configured to repel a short term attack. The stage three 116 fencing may comprise chain link fencing surrounding the vents 50 on all sides, as illustrated in FIG. 4. In each of the stages 112, 114, and 116, hatches 118 may be provided for permitting access. Hatches may also be provided for access to the tanks 60.

The alarm protection 120 may be provided on the stage two fencing and each of the hatches. For instance, the alarm protection 120 may monitor the fencing to detect hammering, cutting, climbing, and lifting of the fencing 110. Alarm protection 120 may also be provided on doors, hatches 118, and to detect unauthorized motion in the buildings, doors, hatches 118, and other areas of the facility or plant 100. The alarm protection 120 may include a network of detection devices in communication with a central monitoring station. The monitoring station may be remote, on-site, or a combination of the two locations.

Vent 50 protection in the form of the apparatus 10 for restricting access to the inlet 52 of the tank vent pipe 50 may be provided, as discussed in greater detail hereinabove.

A closed circuit television system 130 may also be provided as part of the security set-up, providing deterrence, verification of unauthorized access or attempts, and documentation of unauthorized access or attempts. The closed circuit television system 130 may be in communication with the alarm system 120. For example, if the alarm system 120 detects an unauthorized attempt at breaching the stage one fencing 112, the closed circuit television 130 may record such activities with a local camera in close proximity to the location of the attempted breach.

Although particular aspects of an apparatus and method for restricting access to an inlet of a vent or pipe are described herein, the apparatus and method are not limited to those described herein. The apparatus and method are defined more particularly by the following claims.

What is claimed is:

1. A method of substantially restricting access to an inlet of a vent in unrestricted fluid communication with a storage tank by an insertion device, the method comprising:

providing a housing having an entrance opening and an exit opening;

configuring the interior of the housing to have one or more traps substantially restricting passage of the insertion device from the exit opening to the entrance opening and allowing passage of fluid from the entrance opening to the exit opening; and attaching the entrance opening of the housing to the inlet of the vent to permit fluid flow from the inlet of the vent to the entrance opening of the housing to provide unrestricted fluid communication with the storage tank through the housing and the vent.

2. A method in accordance with claim 1, including the step of forming the one or more traps by intersecting two walls positioned within the housing.

3. A method in accordance with claim 2, including the step of inclining at least one of the walls forming the traps toward the entrance opening of the housing.

4. A method in accordance with claim 3, including the step of securing at least one of the walls to the interior of at least one wall forming the housing.

5. A method in accordance with claim 1, wherein the vent includes an outlet and the method includes the step of raising the elevation of the inlet of the vent pipe by positioning an extension between the inlet and outlet of the vent, the extension permitting fluid flow between the outlet and the inlet of the vent.

6. An apparatus for protecting a fluid inlet of an air vent pipe, the apparatus comprising:

an air vent pipe having a fluid inlet and being in unrestricted fluid communication with a water storage tank;

a housing having a fluid entrance and a fluid exit, the fluid entrance being in fluid communication with the fluid inlet of the air vent pipe; and one or more baffles positioned within the housing between the fluid entrance and the fluid exit and defining at least one trap, the traps being effective to hinder placement of an insertion device between the fluid exit and the fluid entrance.

7. An apparatus in accordance with claim 6, wherein a plurality of baffles are provided to define a fluid passage between the fluid entrance and fluid exit and at least one of the baffles is inclined upwardly toward the entrance opening of the housing.

8. An apparatus in accordance with claim 7, wherein the fluid entrance, fluid exit, and fluid passage are sized to permit acceptable fluid flow into and out of the air vent pipe.

9. An apparatus in accordance with claim 8, wherein a blocking panel is provided within the housing spaced a predetermined distance from the fluid exit and generally parallel to the fluid exit, the blocking panel being configured to permit passage of fluid therepast.

10. An access restriction apparatus for substantially preventing insertion of a fluid introduction device into an inlet of an air vent, the apparatus comprising:

a housing having an entrance opening and an exit opening, the entrance opening being positioned adjacent the inlet of the vent for allowing air flow from the inlet of the vent, past the entrance opening, through the housing, and past the exit opening, the one or more traps each comprise the intersection of a pair walls;

the housing having one or more traps positioned between the entrance opening and the exit opening to substantially prevent insertion of a fluid introduction device into the inlet of the vent while allowing air flow from the inlet of the vent, past the entrance opening, through the housing, and past the exit opening; and a blocking panel is provided within the housing spaced a predetermined distance from the exit opening and generally parallel to the exit opening, the blocking panel being configured to permit passage of air therepast.

11. An apparatus in accordance with claim 10, wherein one of the walls comprises a portion of the housing and the other of the walls comprises an inner panel positioned within the housing.

12. An apparatus in accordance with claim 10, wherein each of the walls comprises inner panels positioned within the housing.

13. An apparatus in accordance with claim 10, wherein at least one of the walls forming the intersection is inclined upwardly toward the entrance opening of the housing.

14. An apparatus in accordance with claim 10, wherein the blocking panel is spaced from a wall of the housing to permit fluid air to flow between the blocking panel and the wall of the housing.

15. An apparatus in accordance with claim 10, wherein the blocking panel includes one or more openings to permit air to flow therepast.

16. An apparatus in accordance with claim 10, wherein a plurality of traps are provided, with the traps being positioned on alternating sides of the housing.

17. An apparatus in accordance with claim 10, wherein the walls are secured to sidewalls of the housing.

* * * * *